US010193259B1

(12) United States Patent
Didonato et al.

(10) Patent No.: US 10,193,259 B1
(45) Date of Patent: Jan. 29, 2019

(54) RECEPTACLE CONNECTOR HOUSING WITH HOLD-DOWN RIBS

(71) Applicant: TE CONNECTIVITY CORPORATION, Berwyn, PA (US)

(72) Inventors: Michael Edward Didonato, Camp Hill, PA (US); David Tracy Humphrey, Red Lion, PA (US); Scott Mitchell Wright, Camp Hill, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/851,886

(22) Filed: Dec. 22, 2017

(51) Int. Cl.

| | |
|---|---|
| ***H01R 13/40*** | (2006.01) |
| ***H01R 13/20*** | (2006.01) |
| ***H01R 12/71*** | (2011.01) |
| ***H01R 13/115*** | (2006.01) |
| ***H01R 13/627*** | (2006.01) |

(52) U.S. Cl.
CPC ..... *H01R 13/20* (2013.01); *H01R 12/712* (2013.01); *H01R 13/115* (2013.01); *H01R 13/40* (2013.01); *H01R 13/6271* (2013.01)

(58) Field of Classification Search
CPC ..... H01R 13/4226
USPC ..... 439/595, 871, 382, 849
See application file for complete search history.

(56) References Cited

U.S. PATENT DOCUMENTS

| | | | | |
|---|---|---|---|---|
| 3,980,385 A * | 9/1976 | Hirokawa | H01R 13/432 | 439/246 |
| 5,525,070 A | 6/1996 | Axelsson | | |
| 5,554,051 A * | 9/1996 | Shinji | H01R 13/4368 | 439/595 |
| 5,788,536 A * | 8/1998 | Matsuura | H01R 13/4223 | 439/595 |
| 6,338,654 B1 * | 1/2002 | Sasaki | H01R 13/4223 | 439/595 |
| 6,824,428 B2 * | 11/2004 | Tabata | H01R 13/4223 | 439/382 |
| 9,368,896 B2 * | 6/2016 | Suzuki | H01R 13/4223 | 439/595 |

OTHER PUBLICATIONS

TE Connectivity "110 Low Profile Positive Lock Receptacle and Housings" TE Connectivity; 2016 (3 pages).
TE Connectivity "Housing, Receptacle, Posi-Lock, .110 Series" TE Connectivity; 2013 (1 page).

* cited by examiner

*Primary Examiner* — Tho D Ta

(57) ABSTRACT

A receptacle connector includes a housing and a terminal held within a cavity of the housing. The housing includes a top wall, a bottom wall, and first and second side walls. The housing includes a first hold-down rib in a first corner region of the cavity defined by the top wall and the first side wall, and a second hold-down rib in a second corner region of the cavity defined by the top wall and the second side wall. The terminal defines a receptacle configured to receive a mating tab contact therein through a mating end of the housing. The first hold-down rib engages an outer surface of a first rolled wall of the terminal and the second hold-down rib engages an outer surface of a second rolled wall of the terminal to limit float of the terminal within the cavity.

21 Claims, 5 Drawing Sheets

RECEPTACLE CONNECTOR HOUSING WITH HOLD-DOWN RIBS

BACKGROUND OF THE INVENTION

The subject matter herein relates generally to electrical connectors with receptacle terminals held within housings.

Electrical receptacle connectors are commonly used devices in various electronics applications, such as in appliances, HVAC systems, automobiles, computing systems, and the like. The receptacle connectors typically include a terminal that is crimped to an insulated wire, and a housing that holds the terminal. The terminal defines a receptacle or socket that is configured to receive a tab of a mating or plug connector during a mating operation to establish an electrical connection between the connectors.

The tabs or blades of the mating connector may be manufactured with different sizes, such as different thicknesses, for different applications. Likewise, the terminals of the receptacle connectors are manufactured with different receptacle sizes to accommodate the different tab thicknesses. Known receptacle connectors have different housings that are each configured to accommodate a corresponding one of the different terminal sizes. Producing multiple different housings for the different terminal sizes increases manufacturing costs versus using a single housing to accommodate multiple different sizes of terminals. Thus, it would be cost-effective to produce a single housing that can accommodate both large and small terminal sizes.

But, smaller-sized terminals cannot be reliably installed within the known larger-sized housings (associated with larger-sized terminals) because there would be too much clearance between the terminal and the walls and retention features of the housing. For example, the smaller terminal would be allowed an excessive amount of float within the housing that may allow the terminal to protrude outward from the housing beyond stop features configured to retain the terminal in the housing. Furthermore, due to the smaller size of the receptacle of the terminal, the housing may not properly guide the tab into the receptacle during mating, resulting in stubbing issues and/or mis-mating, which occurs when the tab is received between an outer surface of the terminal and an inner surface of the housing, instead of within the receptacle.

Accordingly, there is a need for an electrical receptacle connector with a single housing that can reliably retain different sizes of terminals within the housing.

SUMMARY OF THE INVENTION

In one embodiment, a receptacle connector is provided that includes a housing and a terminal. The housing includes a mating end and a cable end and defines a cavity therebetween. The housing includes a top wall, a bottom wall, and first and second side walls that extend between and connect the top wall and the bottom wall. The housing includes a first hold-down rib in a first corner region of the cavity defined by the top wall and the first side wall, and a second hold-down rib in a second corner region of the cavity defined by the top wall and the second side wall. The terminal is held in the cavity of the housing. The terminal has a contact segment that includes a floor and first and second rolled walls that extend from the floor. The floor engages the bottom wall of the housing. The contact segment defines a receptacle configured to receive a mating tab contact therein through the mating end of the housing. The first hold-down rib is configured to engage an outer surface of the first rolled wall of the terminal, and the second hold-down rib is configured to engage an outer surface of the second rolled wall of the terminal to limit float of the terminal within the cavity.

In another embodiment, a receptacle connector is provided that includes a housing with a mating end and a cable end and defines a cavity therebetween. The housing is configured to hold a receptacle terminal within the cavity. The housing includes a top wall, a bottom wall, and first and second side walls that extend between and connect the top wall and the bottom wall. The bottom wall is configured to engage a floor of the receptacle terminal. The housing includes a first hold-down rib in a first corner region of the cavity defined by the top wall and the first side wall, and a second hold-down rib in a second corner region of the cavity defined by the top wall and the second side wall. The first hold-down rib is configured to engage an outer surface of a first rolled wall of the receptacle terminal, and the second hold-down rib is configured to engage an outer surface of a second rolled wall of the receptacle terminal to limit float of the receptacle terminal within the cavity.

In another embodiment, a receptacle connector is provided that includes a housing with a mating end and a cable end and defines a cavity therebetween. The housing is configured to hold a receptacle terminal within the cavity. The housing includes a top wall, a bottom wall, and first and second side walls that extend between and connect the top wall and the bottom wall. The bottom wall is configured to engage a floor of the receptacle terminal. The housing includes two cantilevered, deflectable retention latches that extend from an interior surface of the top wall into the cavity to respective distal tips of the retention latches. The retention latches are spaced apart laterally from each other between the first and second side walls. The distal tips are configured to engage the terminal to retain the terminal within the cavity. Each of the retention latches includes a respective inner edge that faces the other retention latch, a respective outer edge that is opposite the respective inner edge, and a respective support wall along the outer edge that extends from the respective distal tip to the top wall of the housing.

DETAILED DESCRIPTION OF THE INVENTION

Certain embodiments of the present disclosure provide an electrical receptacle connector with a housing that has hold-down ribs within a cavity of the housing. The hold-down ribs limit the float of the terminal held within the cavity of the housing, and allow the housing to accommodate and reliably retain terminals with multiple different receptacle sizes, unlike the housings of known receptacle connectors that can only accommodate a single associated terminal size.

In one or more embodiments, the terminals are "positive lock" terminals that include deflectable release latch (e.g., tongue) with a locking dimple that is received within an aperture in the mating tab contact during mating. The dimple enters the aperture with in an audible "snap" that provides an indication of proper mating. The positive lock design may enhance safety and reliability of the mated contact pair for isolated and hard to reach areas. Furthermore, the terminal cannot be extricated from the housing until the release latch is depressed manually, which reduces the potential of exposed live parts or disruption of critical circuitry due to improperly seated or accidentally removed terminals (e.g., relative to other terminal designs). The embodiments of the receptacle connector described herein may have the positive lock design, but are not limited to having the positive lock design.

Figure 1:
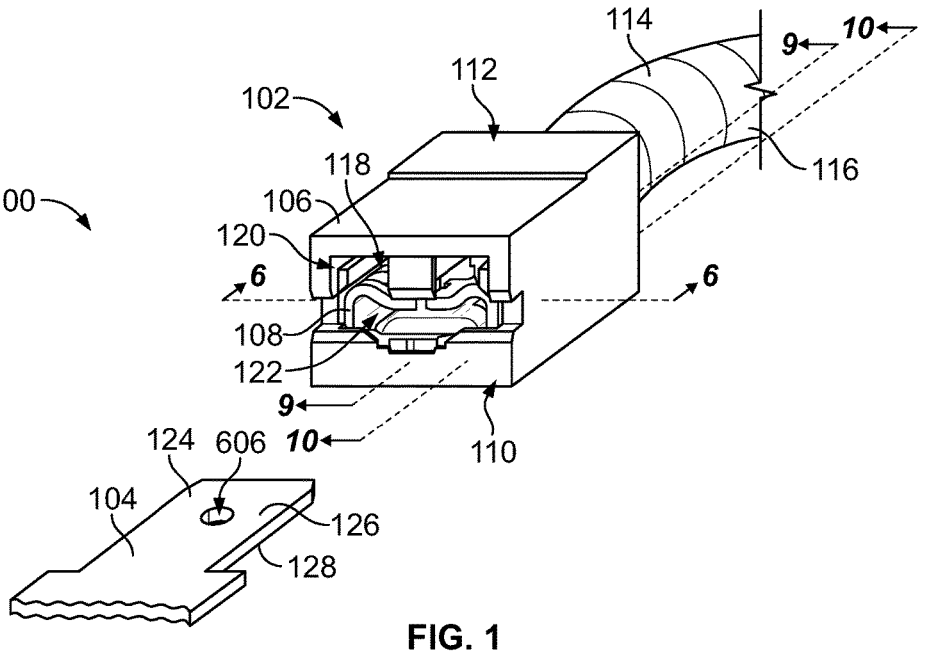
FIG. 1 is a perspective view of a connector system according to an embodiment showing an electrical receptacle connector poised for mating to a mating tab contact.

FIG. 1 is a perspective view of a connector system 100 according to an embodiment showing an electrical receptacle connector 102 poised for mating to a mating tab contact 104 of an electrical mating connector (not shown). The receptacle connector 102 includes a housing 106 and a terminal 108 held by the housing 106. The housing 106 extends between a mating end 110 and a cable end 112 of the housing 106. In the illustrated embodiment, the receptacle connector 102 is an in-line connector such that the mating end 110 is orientated generally parallel to the cable end 112, and the two ends 110, 112 face opposite directions. The receptacle connector 102 may have other orientations in other embodiments.

The receptacle connector 102 is mounted to an electrical cable 114 that protrudes from the cable end 112 of the housing 106. The electrical cable 114 includes one or more core conductors or wires (not shown) surrounded by an insulation jacket 116. The one or more core conductors are terminated (e.g., electrically connected and mechanically secured) to the terminal 108. For example, the cable 114 may be a single insulated wire, a power cable, or the like.

The housing 106 defines a cavity 118 that extends through the housing 106 from the mating end 110 to the cable end 112. The cavity 118 is open at both the mating and cable ends 110, 112. For example, the housing 106 includes an opening 120 at the mating end 110 through which the mating tab contact 104 enters the cavity 118 during mating. The terminal 108 defines a receptacle 122 that aligns with the opening 120 of the housing 106. The receptacle 122 of the terminal 108 is configured to receive the mating tab contact 104 therein (as the tab contact 104 enters the cavity 118) to establish an electrical connection between the terminal 108 and the mating tab contact 104. The connector system 100 may be configured to convey electrical power and/or electrical signals between the receptacle connector 102 and the mating connector.

In the illustrated embodiment, the mating tab contact 104 has a flat, blade member 124 that is configured to enter the receptacle 122 of the terminal 108 and engage walls of the terminal 108 to establish the electrical connection. Although not shown, the mating connector that includes the mating tab contact 104 may be a plug connector that is mounted to a cable, to a circuit board, or the like. The mating tab contact 104 has a thickness defined between a first broad side 126 of the tab contact 104 and a second broad side 128 that is opposite to the first broad side 126. In one or more embodiments described herein, the receptacle connector 102 is configured to reliably accommodate and mate to the mating tab contact 104 as well as one or more other mating tab contacts (not shown) having different thicknesses than the mating tab contact 104. For example, the terminal 108 may be replaced in the housing 106 with another terminal (not shown) having a larger or smaller receptacle than the receptacle 122 of the terminal 108 to accommodate the different mating tab contact. The same housing 106 can be used with multiple different sizes of terminals that are associated with different thickness of mating tab contacts.

Figure 2:
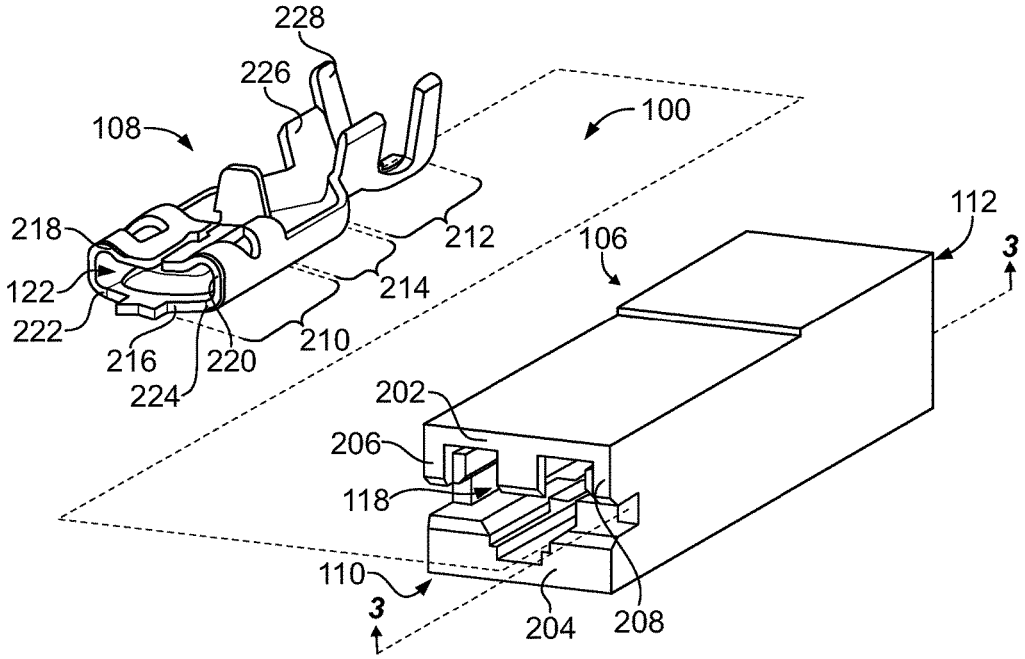
FIG. 2 is an exploded perspective view of the receptacle connector according to an embodiment showing a terminal of the receptacle connector outside of a cavity of the housing of the receptacle connector.

FIG. 2 is an exploded perspective view of the receptacle connector 102 according to an embodiment showing the terminal 108 outside of the cavity 118 of the housing 106. The electrical cable 114 (shown in FIG. 1) is not depicted in FIG. 2.

The housing 106 includes a top wall 202, a bottom wall 204, a first side wall 206, and a second side wall 208. The top wall 202 and the bottom wall 204 are spaced apart from each other and are oriented parallel to each other. The first and second side walls 206, 208 are spaced apart from each other and are oriented parallel to each other. Each of the first and second side walls 206, 208 extends between and connects to the top wall 202 and the bottom wall 204. As used herein, relative or spatial terms such as "top," "bottom," "front," "rear," "upper," and "lower" are only used to distinguish the referenced elements and do not necessarily require particular positions or orientations relative to gravity or to the surrounding environment of the receptacle connector 102.

In the illustrated embodiment, each of the four walls 202, 204, 206, 208 extends from the mating end 110 to the cable end 112 of the housing 106. The cavity 118 is defined vertically between the top wall 202 and the bottom wall 204, and laterally or horizontally between the first side wall 206 and the second side wall 208. In one or more embodiments, the housing 106 is composed of a dielectric material, such as one or more plastics, resins, composites, or other polymers. The housing 106 may be molded. Optionally, the housing 106 may be monolithic, such that the housing 106 has a unitary, one-piece structure or construction. The various features of the housing 106 described herein, such as hold-down ribs 302, 304, cam rib 314, and/or retention latches 318 (all shown in FIG. 3), may be integral to the housing 106, such that the features are formed with the walls 202, 204, 206, 208 during a common molding process and interfaces defined between the walls 202, 204, 206, 208 of the housing 106 and the features are seamless. Although the housing 106 in the illustrated embodiment defines a single cavity 118 and contains a single terminal 108, the housing 106 in an alternative embodiment may define multiple cavities that are similar to the cavity 118, and each of the cavities contains a different terminal therein. The receptacle connector 102 described herein is not limited to holding a single terminal 108 within a single cavity 118.

The terminal 108 has a contact segment 210 and a crimp segment 212. The contact segment 210 defines the receptacle 122 that receives the mating tab contact 104 (shown in FIG. 1). The crimp segment 212 is used to mechanically secure the terminal 108 to the cable 114 (FIG. 1). The contact segment 210 is connected to the crimp segment 212 via a middle segment 214 of the terminal 108 between the contact segment 210 and the crimp segment 212. The contact segment 210 includes a floor 216, a first rolled wall 218, and a second rolled wall 220. The first and second rolled walls 218, 220 extend from opposite first and second edges 222, 224, respectively, of the floor 216. The first and second rolled walls 218, 220 are curved towards each other above the floor 216, defining a ceiling of the receptacle 122.

The crimp segment 212 in the illustrated embodiment includes a wire barrel 226 and an insulation barrel 228. The wire barrel 226 is disposed longitudinally between the insulation barrel 228 and the middle segment 214. The wire barrel 226 is configured to be crimped to the one or more core conductors (e.g., wires) of the cable 114 (FIG. 1) to electrically and mechanically connect the terminal 108 to the cable 114. The insulation barrel 228 is configured to be crimped to the insulation jacket 116 (FIG. 1) of the cable 114, which provides a strain relief for the wire barrel 226. The crimp segment 212 may include only one barrel in an alternative embodiment. In other embodiments, the crimp segment 212 may include an insulation displacement contact or another type of connection interface other than crimp barrels.

The receptacle connector 102 is assembled by crimping (or otherwise terminating) the terminal 108 to the cable 114 (FIG. 1), then loading the terminal 108 into the cavity 118 of the housing 106 through the cable end 112. The terminal 108 is oriented within the cavity 118 such that the floor 216 of the terminal 108 is disposed on and engages the bottom wall 204 of the housing 106.

Figure 3:
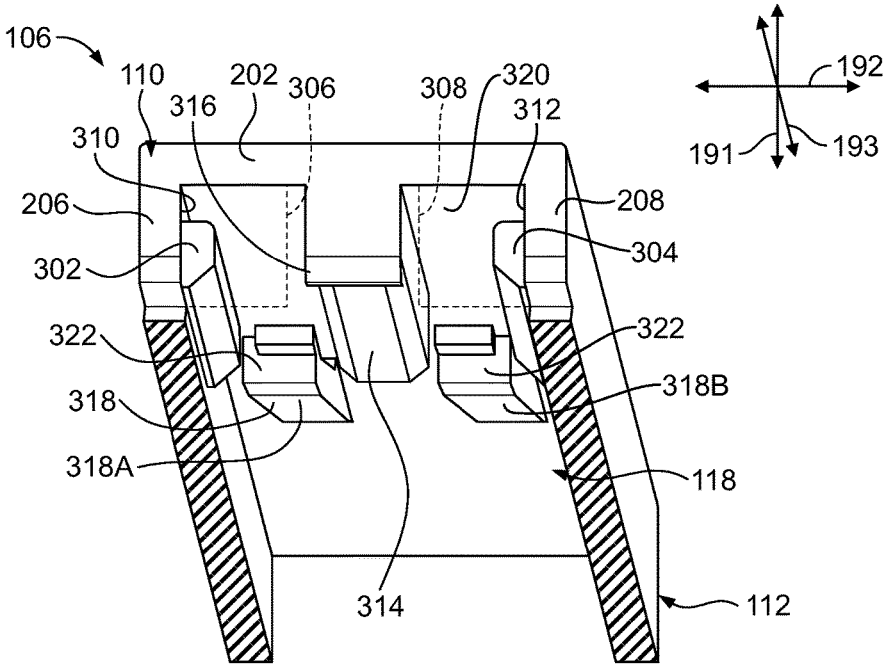
FIG. 3 is a bottom cross-sectional view of an upper portion of the housing according to an embodiment.

FIG. 3 is a bottom cross-sectional view of an upper portion of the housing 106 according to an embodiment. The cross-section is taken along line 3-3 shown in FIG. 2. The illustrated upper portion includes the top wall 202 and portions of the first and second side walls 206, 208 extending from the top wall 202. The housing 106 is oriented with respect to a vertical or elevation axis 191, a lateral axis 192, and a longitudinal axis 193. The longitudinal axis 193 extends through both the mating end 110 and the cable end 112. The axes 191-193 are mutually perpendicular. Although the vertical axis 191 appears to extend generally parallel to gravity, it is understood that the axes 191-193 are not required to have any particular orientation with respect to gravity.

The housing 106 includes various features for retaining the terminal 108 (FIG. 2) in position within the cavity 118 of the housing 106. For example, the housing 106 includes a first hold-down rib 302 in a first corner region 306 of the cavity 118, and a second hold-down rib 304 in a second corner region 308 of the cavity 118. The first corner region 306 is defined by the top wall 202 and the first side wall 206. For example, the first corner region 306 may be a cross-sectional area within a first quadrant of the cavity 118 that is confined by the top wall 202 and the first side wall 206. The second corner region 308 is defined by the top wall 202 and the second side wall 208. The second corner region 308 may be a cross-sectional area within a second quadrant of the cavity 118 confined by the top wall 202 and the second side wall 208. The first hold-down rib 302 is mounted to the first side wall 206, the top wall 202, or both, and extends into the cavity 118. Similarly, the second hold-down rib 304 is mounted to the second side wall 208, the top wall 202, or both, and also extends into the cavity 118. In the illustrated embodiment, the first hold-down rib 302 is mounted to the first side wall 206, and the second hold-down rib 304 is mounted to the second side wall 208. The hold-down ribs 302, 304 are spaced apart from the top wall 202 in the illustrated embodiment, but one or both of the ribs 302, 304 may be mounted to the top wall 202 in an alternative embodiment. The first and second hold-down ribs 302, 304 mirror each other laterally across the cavity 118. For example, the first hold-down rib 302 projects laterally from an inner surface 310 of the first side wall 206 towards the second side wall 208. The second hold-down rib 304 projects laterally from an inner surface 312 of the second side wall 208 towards the first side wall 206.

The first and second hold-down ribs 302, 304 are elongated parallel to the longitudinal axis 193. The ribs 302, 304 are disposed at or proximate to the mating end 110 of the housing 106, and are elongated towards the cable end 112 for a length. The first and second hold-down ribs 302, 304 are positioned within the cavity 118 to engage the first and second rolled walls 218, 220 (FIG. 2), respectively, of the terminal 108 (FIG. 2) to limit the allowable float or movement of the terminal 108 relative to the housing 106. The hold-down ribs 302, 304 in the illustrated embodiment do not extend a full length of the housing 106 to the cable end 112, but rather have lengths associated with the longitudinal lengths of the first and second rolled walls 218, 220. In an alternative embodiment, the hold-down ribs 302, 304 may extend the full longitudinal length of the housing 106.

In one or more embodiment, the hold-down ribs 302, 304 are non-deformable. For example, the hold-down ribs 302, 304 have relatively rigid constructions, and are not configured to compress or deflect when engaged by the terminal 108 (FIG. 2) within the cavity 118. In an alternative embodiment, the hold-down ribs 302, 304 are at least partially deformable, and may be configured to compress and/or deflect upon engagement by the corresponding rolled walls 218, 220 (FIG. 2) of the terminal 108.

The housing 106 may include a cam rib 314 disposed laterally between the first hold-down rib 302 and the second hold-down rib 304. The cam rib 314 extends from the top wall 202 into the cavity 118 (e.g., towards the bottom wall 204 shown in FIG. 2). The cam rib 314 is elongated parallel to the longitudinal axis 193, and parallel to the hold-down ribs 302, 304. In an embodiment, the housing 106 further includes a lip 316 projecting into the cavity 118 from the cam rib 314 towards the bottom wall 204. The lip 316 is located at the mating end 110 of the housing 106.

The housing 106 may also include at least one cantilevered, deflectable retention latch 318 that extends from the top wall 202 into the cavity 118. The housing 106 in the illustrated embodiment includes two of the retention latches 318. A first retention latch 318A is disposed laterally between the first hold-down rib 302 and the cam rib 314. A second retention latch 318B is disposed laterally between the cam rib 314 and the second hold-down rib 304. Each of the retention latches 318 extends from an inner surface 320 of the top wall 202 to a respective distal tip 322 of the retention latch 318 within the cavity 118. The distal tips 322 are suspended within the cavity 118. As described in more detail herein, the distal tips 322 of the retention latches 318 are configured to engage a back or rear end of the contact segment 210 (FIG. 2) of the terminal 108 (FIG. 2) to retain the terminal 108 within the cavity 118. For example, the retention latches 318 may block relative movement of the terminal 108 towards the cable end 112 of the housing 106. Although the housing 106 includes two retention latches 318A, 318B in the illustrated embodiment, the housing 106 may have a different number of retention latches 318, such as only one, in alternative embodiments.

Figure 4:
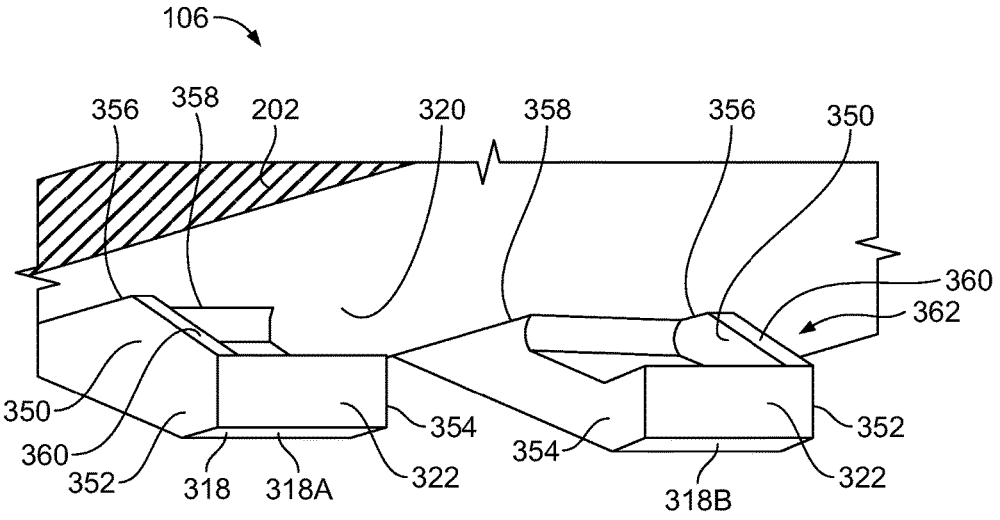
FIG. 4 is a cross-sectional view of a portion of the housing showing retention latches of the housing according to an alternative embodiment.

FIG. 4 is a cross-sectional view of a portion of the housing 106 showing the retention latches 318 (e.g., latches 318A, 318B) according to an alternative embodiment. The cam rib 314 (FIG. 3) is not shown in FIG. 4 to better illustrate the retention latches 318. Each of the retention latches 318 in the illustrated embodiment includes a respective support wall 350 that extends from the distal tip 322 of the retention latch 318 to the inner surface 320 of the top wall 202 of the housing 106. The support walls 350 structurally support the retention latches 318 to allow the retention latches 318 to provide relatively high retention forces (e.g., relative to similarly-sized latches without support walls) to retain the terminal 108 (FIG. 2) within the housing 106 without damaging the latches 318. The support walls 350 may be thin and web-like.

In the illustrated embodiment, each of the support walls 350 is disposed along an outer edge 352 of the respective latch 318. The outer edges 352 of the two latches 318 face away from each other. The support walls 350 are not disposed along respective inner edges 354 of the latches 318 that face each other. The respective inner edge 354 of each retention latch 318 is opposite the respective outer edge 352 of the same retention latch 318. When the terminal 108 is loaded into the cavity 118 (FIG. 2) through the cable end 112 (FIG. 2), the support walls 350 may restrict the deflection of the outer edges 352 of the latches 318 towards the inner surface 320 of the top wall 302. As the terminal 108 is loaded, the inner edges 354 of the latches 318 may deflect towards the inner surface 320 a greater amount or distance than the outer edges 352. Since the inner edges 354 of the latches 318 are able to deflect out of the way of the terminal 108, the support walls 350 still allow the terminal 108 to be loaded into the housing 106. One or more effects of the support walls 350 may include increasing the robustness of the retention latches 318 for retaining the terminal 108 within the housing 106 without unduly increasing the insertion forces necessary to load the terminal 108 into the housing 106. The support walls 350 may also be useful on relatively small and/or narrow retention latches 318, such as in embodiments in which the housing 102 has a small form factor and there is limited space for larger and/or wider latches.

Each of the support walls 350 has a first end that is attached to the distal tip 322 of the respective latch 318 and a second end that is attached to the inner surface 320 of the top wall 202 at a support wall interface 356. In an embodiment, the support wall interface 356 is located between the distal tip 322 of the respective latch 318 and a fixed end 358 of the respective latch 318 at the inner surface 320.

Figure 5:
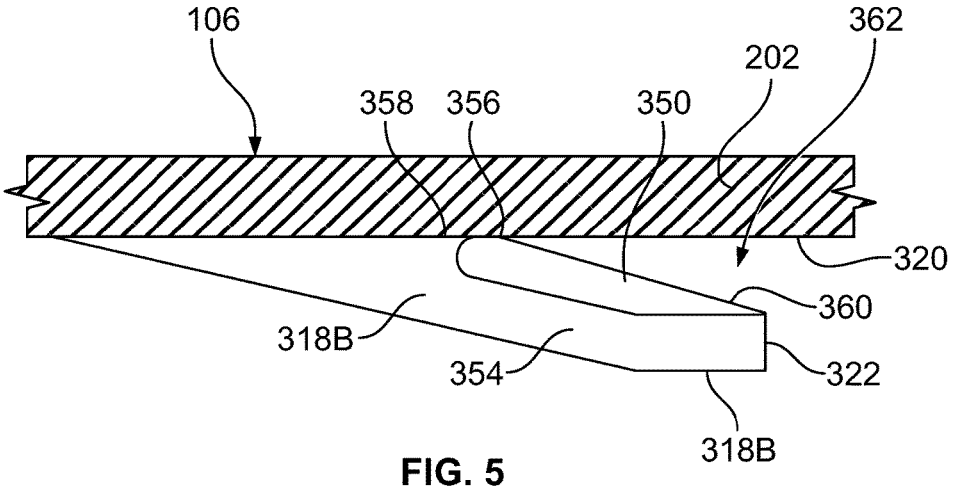
FIG. 5 shows an inner edge of one of the retention latches according to the embodiment shown in FIG. 4.

Additional reference is made to FIG. 5, which shows the inner edge 354 of the second retention latch 318B according to the embodiment shown in FIG. 4. As shown in FIG. 5, the support wall interface 356 between the support wall 350 and the top wall 202 of the housing 106 is located axially between the distal tip 322 of the latch 318B and the fixed end 358 of the latch 318B. In the illustrated embodiment, a front edge 360 of the support wall 350 at the distal tip 322 does not extend perpendicular to the inner surface 320 of the top wall 202, but rather extends at an oblique angle relative to the inner surface 320. As a result, a wedge-shaped void 362 is defined between the front edge 360 of the support wall 350 and the inner surface 320 of the top wall 202. The creation of the wedge-shaped void 362 may reduce the insertion forces necessary to deflect the latches 318 in order to load the terminal 108 (FIG. 2) into the cavity 118 (FIG. 2), at least relative to the support walls 350 lacking the voids 362 and spanning the entire space between the latches 318 and the top wall 202.

Figure 6:
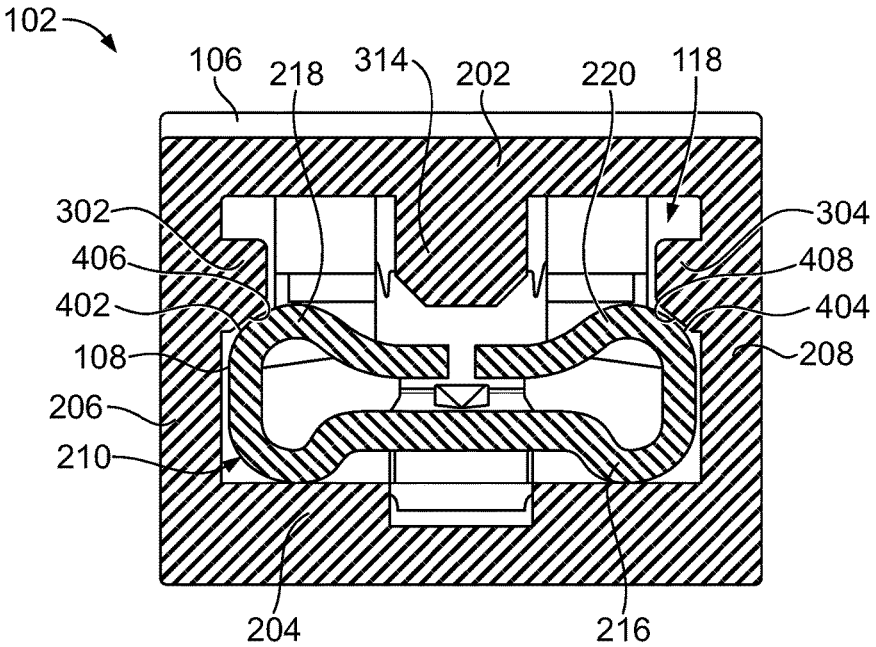
FIG. 6 is a front cross-sectional view of the receptacle connector in an assembled state according to an embodiment.

FIG. 6 is a front cross-sectional view of the receptacle connector 102 in an assembled state according to an embodiment. The cross-section is taken along the line 6-6 shown in FIG. 1. The cross-section extends through the contact segment 210 of the terminal 108, and through the first and second hold-down ribs 302, 304 and the cam rib 314 of the housing 106. The terminal 108 within the cavity 118 is held vertically between the bottom wall 204 of the housing 106 and the hold-down ribs 302, 304. The floor 216 of the terminal 108 is sitting on the bottom wall 204 in the illustrated embodiment. The hold-down ribs 302, 304 extend over the contact segment 210 of the terminal 108 between the terminal 108 and the top wall 202 of the housing 106. The first hold-down rib 302 extends partially over, and is configured to engage, an outer surface 402 of the first rolled wall 218 of the terminal 108. The second hold-down rib 304 extends partially over, and is configured to engage, an outer surface 404 of the second rolled wall 220. The first and second hold-down ribs 302, 304 are spaced apart from the corresponding rolled walls 218, 220 by respective clearance gaps in the illustrated embodiment. The clearance gaps allow for unrestricted loading of the terminal 108 into the cavity 118 to assemble the receptacle connector 102.

The hold-down ribs 302, 304 are designed to limit the vertical float of the terminal 108 that is permitted within the cavity 118. For example, the hold-down ribs 302, 304 are disposed more proximate to the rolled walls 218, 220 of the terminal 108 than the proximity of the cam rib 314 to the rolled walls 218, 220. If the housing 106 did not include the hold-down ribs 302, 304, the terminal 108 would have a greater amount of vertical float, as the terminal 108 could move between the bottom wall 204 and the cam rib 314. There are several disadvantages associated with the greater amount of float, such as a risk that the terminal 108 falls out of the cavity 118 and/or a risk of stubbing or mis-mating with the mating tab contact 104 (FIG. 1). The hold-down ribs 302, 304 limit the permissible amount of float, and reduce or eliminate the risks of the terminal 108 falling out of the cavity 118 and stubbing or mis-mating with the mating tab contact 104.

In an embodiment, the first hold-down rib 302 has a lower surface 406 that faces generally towards the bottom wall 204. The lower surface 406 is sloped transverse to the first side wall 206, and to the top and bottom walls 202, 204. The lower surface 406 is configured to accommodate a sloped contour of the first rolled wall 218 of the terminal 108. For example, the lower surface 406 may have a slope that is between about 30 degrees and about 60 degrees relative to a plane of the first side wall 206. The lower surface 406 may be linear or curved. Likewise, the second hold-down rib 304 has a lower surface 408 that faces generally towards the bottom wall 204, and is sloped transverse to the second side wall 208, and to both the top and bottom walls 202, 204. The lower surface 408 is configured to accommodate a sloped contour of the second rolled wall 220. The lower surface 408 may be linear or curved, and may have a slope that is between about 30 degrees and about 60 degrees relative to a plane of the second side wall 208.

Figure 7:
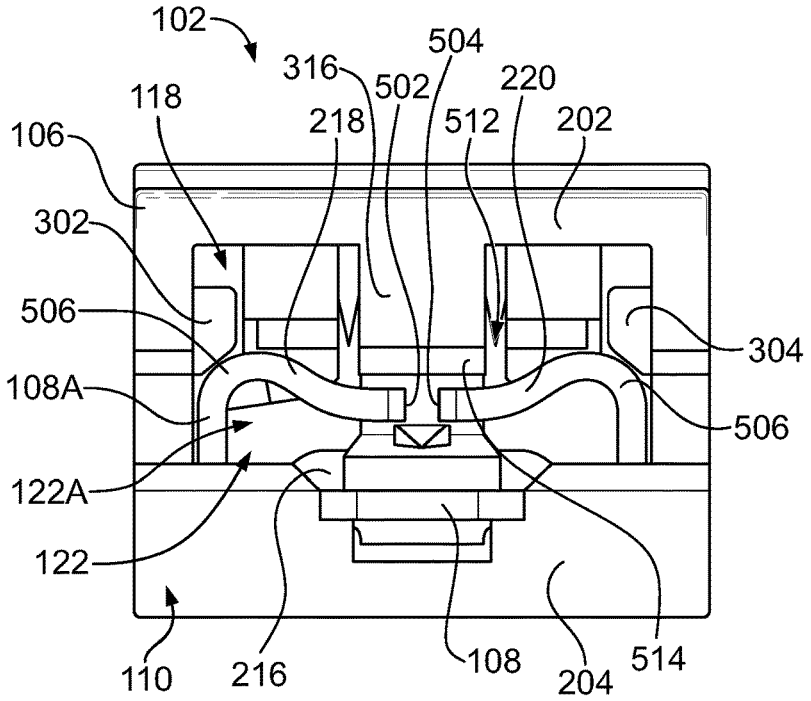
FIG. 7 is a front view of the receptacle connector with a first terminal disposed in the cavity of the housing according to an embodiment.
Figure 8:
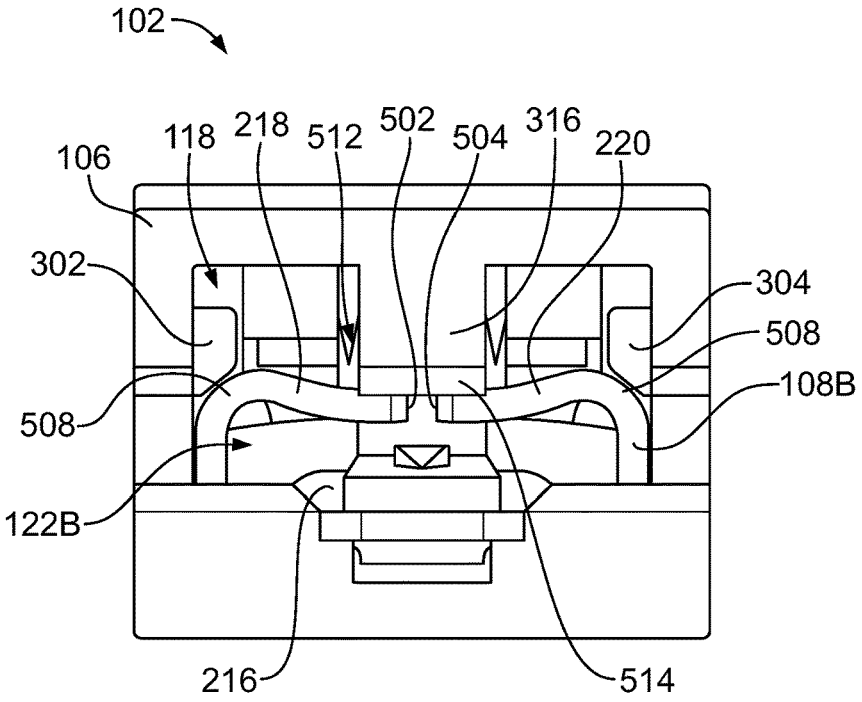
FIG. 8 is a front view of the receptacle connector with a second terminal disposed in the cavity of the housing in place of the first terminal shown in FIG. 7.

FIG. 7 is a front view of the receptacle connector 102 with a first terminal 108A disposed in the cavity 118 of the housing 106 according to an embodiment. FIG. 8 is a front view of the receptacle connector 102 with a second terminal 108B disposed in the cavity 118 of the housing 106 in place of the first terminal 108A shown in FIG. 7. The first terminal 108A defines a smaller receptacle 122A than the receptacle 122B defined by the second terminal 108B. For example, the receptacle 122A has a narrower height than the height of the receptacle 122B. The housing 106 in FIG. 7 is the same as the housing 106 in FIG. 8. The only difference between the receptacle connectors 102 in FIGS. 7 and 8 is the terminals 108A, 108B. The housing 106 is configured to accommodate different sizes of terminals 108A, 108B without modification to the housing 106. For example, the first and second hold-down ribs 302, 304 are configured to limit vertical float of the smaller terminal 108A of FIG. 7 and the larger terminal 108B of FIG. 8.

The rolled walls 218, 220 of the terminals 108A, 108B extend from the floor 216 to respective distal ends 502, 504. The distal end 502 of the first rolled wall 218 is disposed proximate to the distal end 504 of the second rolled wall 220, and both distal ends 502, 504 are suspended over the floor 216 along a ceiling of the respective receptacle 122A, 122B. The distal ends 502, 504 of the rolled walls 218, 220 of the smaller terminal 108A in FIG. 7 are located more proximate to the floor 216 than a proximity of the distal ends 502, 504 of the rolled walls 218, 220 of the larger terminal 108B in FIG. 8 to the floor 216. Due to the different positions of the distal ends 502, 504 of the rolled walls 218, 220, the receptacle 122A of the smaller terminal 108A has a shorter or narrower height than the receptacle 122B of the larger terminal 108B. The two receptacles 122A, 122B in the illustrated embodiment may have approximately equal lateral widths.

In an embodiment, although the distal ends 502, 504 of the rolled walls 218, 220 are positioned differently in the two terminals 108A, 108B, intermediate segments 506 of the rolled walls 218, 220 of the smaller terminal 108A have similar positions as intermediate segments 508 of the rolled walls 218, 220 of the larger terminal 108B. The intermediate segments 506, 508 are lengths of the rolled walls 218, 220 between the floor 216 and the distal ends 502, 504. As shown in FIG. 5, the intermediate segments 506 of the rolled walls 218, 220 of the smaller terminal 108A are disposed proximate to the hold-down ribs 302, 304. Similarly, the intermediate segments 508 of the rolled walls 218, 220 of the larger terminal 108B in FIG. 8 are also disposed proximate to the hold-down ribs 302, 304. The hold-down ribs 302, 304 are configured to engage the intermediate segments 506 of the smaller terminal 108A and the intermediate segments 508 of the larger terminal 108B to limit vertical float of each of the terminals 108A, 108B. Therefore, the housing 106 is configured to limit the vertical float of multiple different sizes of terminals without modifying the housing 106.

The lip 316 of the housing 106 may be configured to reduce the risk of stubbing and mis-mating, particularly when the smaller terminal 108A is housed within the cavity 118. Mis-mating may occur when the mating tab contact 104 (FIG. 1) is received in the cavity 118 but not in the receptacle 122 of the terminal 108, such that the mating tab contact 104 enters a space 512 that is above the rolled walls 218, 220 (e.g., between the rolled walls 218, 220 and the top wall 202 of the housing 106. As shown in FIGS. 7 and 8, mis-mating may be more of a concern for the smaller terminal 108A than the larger terminal 108B due to the narrower or shorter height of the receptacle 122A. The lip 316 is located at the mating end 110 and extends into the space 512, blocking the mating tab contact 104 from entering the space 512. Furthermore, the lip 316 may be configured to reduce the risk of stubbing during the mating process. For example, the lip 316 may include a tapered edge 514 (shown in more detail in FIG. 9) that provides a lead-in surface to guide the mating tab contact 104 into alignment with the receptacle 122. The tapered edge 514 guides the mating tab contact 104 downward (e.g., in a direction towards the bottom wall 204).

Figure 9:
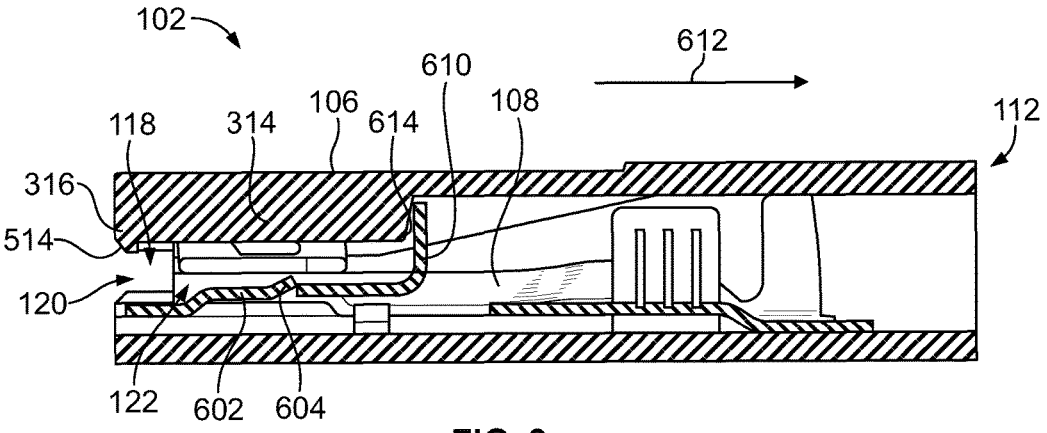
FIG. 9 is a side cross-sectional view of the receptacle connector according to an embodiment.

FIG. 9 is a side cross-sectional view of the receptacle connector 102 according to an embodiment. The cross-section is taken along line 9-9 shown in FIG. 1. The cross-section in FIG. 9 splits the receptacle connector 102 down a lateral centerline, extending through the lip 316 and the cam rib 314 of the housing 106. As shown in FIG. 9, the tapered edge 514 of the lip 316 provides a lead-in surface that guides the mating tab contact 104 (FIG. 1) downward into the opening 120 of the cavity 118 into alignment with the receptacle 122 of the terminal 108.

In an embodiment, the terminal 108 includes a deflectable tongue 602 that projects into the receptacle 122 from the floor 216. The tongue 602 includes a dimple 604 that protrudes from the tongue 602. The dimple 604 is configured to be received within an aperture 606 (shown in FIG. 1) of the mating tab contact 104 (FIG. 1) when the mating tab contact 104 is fully loaded in the receptacle 122. The engagement between the dimple 604 and the aperture 606 secures the mating tab contact 104 within the receptacle 122. Furthermore, the reception of the dimple 604 into the aperture 606 may provide an auditory and/or tactile notification that indicates to an operator that the mating tab contact 104 is fully loaded and secured within the receptacle 122. In an embodiment, the terminal 108 includes a release latch 610 at an end of the tongue 602. The release latch 610 extends upward into a space behind the cam rib 314. Manual pulling on the housing 106 in a release direction 612 towards the cable end 112 causes a rear surface 614 of the cam rib 314 to deflect the release latch 610 and the tongue 602 rearward and downward, causing the dimple 604 to drop out of the aperture 606. The mating tab contact 104 is allowed to be removed from the receptacle 122 after the dimple 604 is released from the aperture 606. The deflectable tongue 602, dimple 604, and release latch 610 are optional features of the housing 106, and may be omitted from one or more alternative embodiments of the receptacle connector 102.

Figure 10:
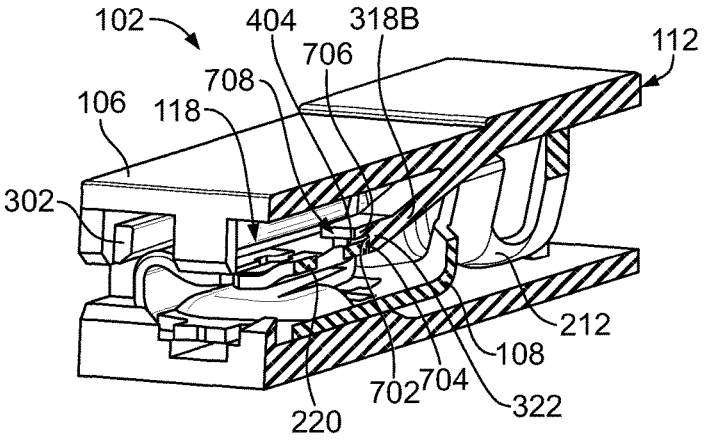
FIG. 10 is a side perspective cross-sectional view of the receptacle connector according to an embodiment.

FIG. 10 is a side perspective cross-sectional view of the receptacle connector 102 according to an embodiment. The cross-section is taken along line 10-10 shown in FIG. 1. The cross-section extends through the retention latch 318B of the housing 106, and through the second rolled wall 220 of the terminal 108. In an embodiment, the distal tip 322 of the retention latch 318B includes a shoulder 702 that is configured to engage an edge 704 (e.g., a rear edge) of the rolled wall 220 that faces towards the crimp segment 212 of the terminal 108. The shoulder 702 provides a hard stop surface that retains the terminal 108 within the cavity 118 by blocking the rolled wall 220 from moving towards the cable end 112 of the housing 106.

The distal tip 322 may also include a shelf 706 that projects beyond the shoulder 702 to a distal end 708 of the retention latch 318B. The shelf 706 is configured to engage the outer surface 404 of the second rolled wall 220 to limit vertical float of the terminal 108 within the cavity 118. The shelf 706 provides a hold-down function similar to the first hold-down rib 302 and the second hold-down rib 304 (shown in FIG. 6). Although not shown in FIG. 10, the first retention latch 318A may be identical, or at least similar, to the second retention latch 318B, such that the first retention latch 318A includes a shoulder that engages an edge of the first rolled wall 218 and a shelf projecting from the shoulder that engages the outer surface 402 of the first rolled wall 218 to limit vertical float of the terminal 108.

Although not shown, the retention latch 318B according to the embodiment shown in FIG. 10 may also include a support wall like the support walls 350 shown in FIGS. 4 and 5.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A receptacle connector comprising:

a housing including a mating end and a cable end and defining a cavity therebetween, the housing including a top wall, a bottom wall, and first and second side walls that extend between and connect the top wall and the bottom wall, the housing including a first hold-down rib in a first corner region of the cavity defined by the top wall and the first side wall, and a second hold-down rib in a second corner region of the cavity defined by the top wall and the second side wall, the first hold-down rib extending from the first side wall, the second hold-down rib extending from the second side wall; and a terminal held in the cavity of the housing, the terminal having a contact segment that includes a floor and first and second rolled walls that extend from the floor, the floor engaging the bottom wall of the housing, the contact segment defining a receptacle configured to receive a mating tab contact therein through the mating end of the housing, wherein the first hold-down rib extends over the terminal and is configured to engage an outer surface of the first rolled wall of the terminal and the second hold-down rib extends over the terminal and is configured to engage an outer surface of the second rolled wall of the terminal such that the terminal is held vertically between the bottom wall of the housing and the first and second hold-down ribs of the housing to limit vertical float of the terminal within the cavity.

2. The receptacle connector of claim 1, wherein the housing is monolithic such that the first and second hold-down ribs are integral to the housing.

3. The receptacle connector of claim 1, wherein the first and second hold-down ribs are each elongated parallel to a longitudinal axis of the housing that extends through the mating end and the cable end.

4. The receptacle connector of claim 1, wherein the first and second hold-down ribs are non-deformable.

5. The receptacle connector of claim 1, wherein each of the first and second hold-down ribs has a respective lower surface facing generally towards the bottom wall, wherein the lower surfaces of the first and second hold-down ribs are sloped transverse to the first and second side walls and to the top and bottom walls to accommodate sloped contours of the first and second rolled walls of the terminal.

6. The receptacle connector of claim 1, wherein the housing includes a cantilevered, deflectable retention latch that extends from the top wall to a distal tip of the retention latch within the cavity, the distal tip including a shoulder configured to engage an edge of the first rolled wall of the terminal to retain the terminal within the cavity, the distal tip also including a shelf projecting beyond the shoulder to a distal end of the retention latch, the shelf configured to engage the outer surface of the first rolled wall to limit vertical float of the terminal within the cavity.

7. The receptacle connector of claim 1, wherein the housing includes two cantilevered, deflectable retention latches that extend from the top wall to respective distal tips of the retention latches within the cavity, the retention latches spaced apart laterally from each other, the distal tips configured to engage the terminal to retain the terminal within the cavity, wherein each of the retention latches includes a respective inner edge that faces the other retention latch, a respective outer edge that is opposite the respective inner edge, and a respective support wall along the outer edge that extends from the respective distal tip to the top wall of the housing.

8. The receptacle connector of claim 1, wherein the housing includes a cam rib extending into the cavity from the top wall, the cam rib disposed laterally between the first and second hold-down ribs.

9. The receptacle connector of claim 8, wherein the housing includes a lip projecting from the cam rib towards the bottom wall at the mating end of the housing.

10. The receptacle connector of claim 9, wherein the lip has a tapered edge to guide the mating tab contact into alignment with the receptacle of the terminal during mating.

11. A receptacle connector comprising:

a housing including a mating end and a cable end and defining a cavity therebetween, the housing including a top wall, a bottom wall, and first and second side walls that extend between and connect the top wall and the bottom wall, the housing including a first hold-down rib in a first corner region of the cavity defined by the top wall and the first side wall, and a second hold-down rib in a second corner region of the cavity defined by the top wall and the second side wall; and a terminal held in the cavity of the housing, the terminal having a contact segment that includes a floor and first and second rolled walls that extend from the floor, the floor engaging the bottom wall of the housing, the contact segment defining a receptacle configured to receive a mating tab contact therein through the mating end of the housing, wherein the terminal includes a deflectable tongue projecting into the receptacle from the floor, the tongue including a dimple that is configured to be received within an aperture of the mating tab contact to secure the mating tab contact within the receptacle, wherein the first hold-down rib is configured to engage an outer surface of the first rolled wall of the terminal and the second hold-down rib is configured to engage an outer surface of the second rolled wall of the terminal to limit float of the terminal within the cavity.

12. A receptacle connector comprising:

a housing including a mating end and a cable end and defining a cavity therebetween, the housing configured to hold a receptacle terminal within the cavity, the housing including a top wall, a bottom wall, and first and second side walls that extend between and connect the top wall and the bottom wall, the bottom wall configured to engage a floor of the receptacle terminal, the housing including a first hold-down rib in a first corner region of the cavity defined by the top wall and the first side wall, and a second hold-down rib in a second corner region of the cavity defined by the top wall and the second side wall, wherein the first hold-down rib is configured to engage an outer surface of a first rolled wall of the receptacle terminal, and the second hold-down rib is configured to engage an outer surface of a second rolled wall of the receptacle terminal to limit float of the receptacle terminal within the cavity, and wherein each of the first and second hold-down ribs has a respective lower surface facing generally towards the bottom wall, wherein the lower surfaces of the first and second hold-down ribs are sloped transverse to the first and second side walls and to the top and bottom walls to accommodate sloped contours of the first and second rolled walls of the receptacle terminal.

13. The receptacle connector of claim 12, wherein the first hold-down rib extends from the first side wall and the second hold-down rib extends from the second side wall.

14. The receptacle connector of claim 12, wherein the housing includes a cantilevered, deflectable retention latch that extends from the top wall to a distal tip of the retention latch within the cavity, the distal tip including a shoulder configured to engage an edge of the first rolled wall of the receptacle terminal to retain the receptacle terminal within the cavity, the distal tip also including a shelf projecting beyond the shoulder to a distal end of the retention latch, the shelf configured to engage the outer surface of the first rolled wall to limit vertical float of the terminal within the cavity.

15. The receptacle connector of claim 12, wherein the housing includes two cantilevered, deflectable retention latches that extend from the top wall to respective distal tips of the retention latches within the cavity, the retention latches spaced apart laterally from each other, the distal tips configured to engage the terminal to retain the terminal within the cavity, wherein each of the retention latches includes a respective inner edge that faces the other retention latch, a respective outer edge that is opposite the respective inner edge, and a respective support wall along the outer edge that extends from the respective distal tip to the top wall of the housing.

16. The receptacle connector of claim 12, wherein the housing includes a cam rib extending into the cavity from the top wall, the cam rib disposed laterally between the first and second hold-down ribs, the housing also including a lip projecting from the cam rib towards the bottom wall at the mating end of the housing.

17. The receptacle connector of claim 12, wherein the first hold-down rib extends from the first side wall and is configured to project over the first rolled wall of the terminal and the second hold-down rib extends from the second side wall and is configured to project over the second rolled wall of the terminal such that the bottom wall and the first and second hold-down ribs of the housing are configured to hold the terminal therebetween to limit vertical float of the terminal within the cavity.

18. A receptacle connector comprising:

a housing including a mating end and a cable end and defining a cavity therebetween, the housing configured to hold a receptacle terminal within the cavity, the housing including a top wall, a bottom wall, and first and second side walls that extend between and connect the top wall and the bottom wall, the bottom wall configured to engage a floor of the receptacle terminal, wherein the housing includes two cantilevered, deflectable retention latches that extend from an interior surface of the top wall into the cavity to respective distal tips of the retention latches, the retention latches spaced apart laterally from each other between the first and second side walls, the distal tips configured to engage the receptacle terminal to retain the receptacle terminal within the cavity, wherein each of the retention latches includes a respective inner edge that faces the other retention latch, a respective outer edge that is opposite the respective inner edge, and a respective support wall along the outer edge that extends from the respective distal tip to the top wall of the housing.

19. The receptacle connector of claim 18, wherein a front edge of the support wall of each of the retention latches extends from the respective distal tip at an oblique angle relative to the interior surface of the top wall of the housing such that a wedge-shaped void is defined between the front edge of the support wall and the interior surface of the top wall.

20. The receptacle connector of claim 18, wherein the housing includes a first hold-down rib and a second hold-down rib, the first hold-down rib extending from the first side wall and configured to project over a first rolled wall of the receptacle terminal, the second hold-down rib extending from the second side wall and configured to project over a second rolled wall of the receptacle terminal such that the bottom wall and the first and second hold-down ribs of the housing are configured to hold the receptacle terminal therebetween to limit vertical float of the receptacle terminal within the cavity.

21. The receptacle connector of claim 18, wherein the support wall of each of the retention latches is spaced apart from the respective inner edge of the retention latch.

* * * * *